US009223244B2

(12) United States Patent
Murota et al.

(10) Patent No.: US 9,223,244 B2
(45) Date of Patent: Dec. 29, 2015

(54) IMAGE WRITING DEVICE, IMAGE FORMING APPARATUS, AND IMAGE WRITING METHOD

(71) Applicants: Koichi Murota, Tokyo (JP); Tatsuo Ohyama, Kanagawa (JP); Yuichiro Shukuya, Kanagawa (JP); Masashi Suzuki, Saitama (JP); Tatsuya Miyadera, Kanagawa (JP)

(72) Inventors: Koichi Murota, Tokyo (JP); Tatsuo Ohyama, Kanagawa (JP); Yuichiro Shukuya, Kanagawa (JP); Masashi Suzuki, Saitama (JP); Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/608,732

(22) Filed: Jan. 29, 2015

(65) Prior Publication Data

US 2015/0261116 A1 Sep. 17, 2015

(30) Foreign Application Priority Data

Mar. 17, 2014 (JP) ..... 2014-053825

(51) Int. Cl.
*B41J 2/385* (2006.01)
*G03G 15/043* (2006.01)

(52) U.S. Cl.
CPC ..... *G03G 15/043* (2013.01)

(58) Field of Classification Search
CPC ..... B41J 2/45
USPC ..... 347/130; 358/1.2, 1.5, 1.9, 1.12, 1.14, 358/3.26, 474, 505, 496, 497, 518, 536, 525
See application file for complete search history.

(56) References Cited

U.S. PATENT DOCUMENTS

| | | | | |
|---|---|---|---|---|
| 8,487,973 | B2 | 7/2013 | Kinoshita et al. | |
| 8,547,409 | B2 | 10/2013 | Yokoyama et al. | |
| 8,570,355 | B2 | 10/2013 | Murota | |
| 8,587,626 | B2 | 11/2013 | Komai et al. | |
| 8,605,131 | B2 | 12/2013 | Ohyama | |
| 8,723,905 | B2 | 5/2014 | Kinoshita et al. | |
| 8,817,320 | B2 | 8/2014 | Shirasaki et al. | |
| 8,848,238 | B2 * | 9/2014 | Miyadera et al. | 358/1.5 |
| 8,902,463 | B2 | 12/2014 | Shukuya | |
| 2007/0013925 | A1 * | 1/2007 | Ishikawa | 358/1.7 |
| 2009/0122368 | A1 * | 5/2009 | Saito et al. | 358/504 |
| 2012/0207498 | A1 | 8/2012 | Miyadera et al. | |
| 2013/0044176 | A1 | 2/2013 | Shirasaki et al. | |
| 2014/0002564 | A1 * | 1/2014 | Miyadera et al. | 347/118 |
| 2014/0192131 | A1 * | 7/2014 | Hamanaka | 347/236 |

FOREIGN PATENT DOCUMENTS

JP 2013-039798 2/2013

* cited by examiner

*Primary Examiner* — Julian Huffman
*Assistant Examiner* — Sharon A Polk
(74) *Attorney, Agent, or Firm* — Oblon, McClelland, Maier & Neustadt, L.L.P.

(57) ABSTRACT

An image writing device includes an exposure unit including an exposure head, writing an image onto an image bearing surface of a photoconductor by causing the exposure head to repeatedly expose; and a write control unit transmitting image data to be written by the exposure unit to the exposure unit on a one-line basis. Further the write control unit generates a write cycle reference signal having a cycle corresponding to writing resolution, counts a clock by a predetermined count value, generates a write cycle signal by delaying the write cycle reference signal by a time period, generates a data request signal to request transmission of one line of the image data to a controller unit based on the write cycle signal, and stores the one line of the image data transmitted from the controller unit.

11 Claims, 5 Drawing Sheets

IMAGE WRITING DEVICE, IMAGE FORMING APPARATUS, AND IMAGE WRITING METHOD

CROSS-REFERENCE TO RELATED APPLICATIONS

The present application is based on and claims the benefit of priority under 35 U.S.C §119 of Japanese Patent Application No. 2014-053825 filed Mar. 17, 2014, the entire contents of which are hereby incorporated herein by reference.

BACKGROUND OF THE INVENTION

1. Field of the Invention

The present invention generally relates to an image writing device, in which an image is written on an image bearing surface of a photoconductor moving in the sub-scanning direction and being repeatedly exposed along the main-scanning direction by using an exposure head where plural light-emitting elements are arranged in the main-scanning direction, an image forming apparatus including the image writing device, and an image writing method.

2. Description of the Related Art

An image forming apparatus employing an electrophotography method such as a copier, a printer, a facsimile machine, a digital multifunction peripheral, etc., has been widely used. The image forming apparatus employing the electrophotography method includes an image writing device that writes an image and forms an electrostatic latent image by exposing an image bearing surface of a photoconductor.

Then, the image forming apparatus develops the electrostatic latent image, which is formed on the image bearing surface of a photoconductor by the image writing device, with developer such as toner, etc., so as to form a toner image. The toner image is transferred onto a recording medium and is fixed thereon, and the recording medium, on which the fixed toner image is formed, is output from the image forming apparatus.

As the image writing device included in such an image forming apparatus, an image writing device employing a laser writing method (a raster optical system method) is mainly used. However, recently, more and more image writing devices employing a fixed writing method using the exposure head as described above have been used. As the exposure head, a light-emitting diode (LED) array is typically used where plural LED elements are arranged in the main scanning direction with a density in accordance with a resolution.

The image writing device that uses the LED array exposes a charged image bearing surface of the photoconductor by using light emission of the LED elements of the LED array to form the electrostatic latent image, so as to write the image. To that end, an LED array drive section controls the turning on and off of the LED elements of the LED array based on image data to be written. The image data are stored into a line memory on a main-scanning line basis, and are transferred to an LED array drive section in a line cycle corresponding to the resolution.

In the image writing device employing such a fixed writing method, it is desired to adjust an image writing start position in the sub-scanning direction, which is the moving direction of the image bearing surface, with high accuracy of less than or equal to one line cycle of the main scanning. To that end, there is a known method in which a line memory corresponding to plural lines are provided in a write control section, so that the timings of transmitting data from the line memory to the LED array are shifted from each other.

For example, Japanese Laid-open Patent Publication No. 2013-039798 discloses a technique in which a resist correction, which refers to the adjustment of the image writing start position in the sub-scanning direction, is performed with the high accuracy of less than or equal to the one line cycle of the main scanning. To that end, a method is employed in which the timings at which the pixel information is input from the line memory to the LED array are shifted from each other, and the timings of designating the read addresses of the line memory by a line memory control section, that is, the read timings are accordingly shifted.

SUMMARY OF THE INVENTION

According to an aspect of the present invention, an image writing device includes an exposure unit including an exposure head, and writing an image onto an image bearing surface of a photoconductor, which moves in a sub-scanning direction at a predetermined speed, by causing the exposure head, where plural light-emitting elements are arranged in a main-scanning direction orthogonal to the sub-scanning direction and in a surface along the image bearing surface, to repeatedly expose the image bearing surface along the main-scanning direction; and a write control unit transmitting image data, which are to be written by the exposure unit, to the exposure unit on a one-line basis. Further the write control unit includes a write cycle reference signal generation unit generating a write cycle reference signal having a cycle corresponding to writing resolution, a write cycle signal delay counter counting a clock by a predetermined count value that is set in the write cycle signal delay counter, a write cycle signal generation unit generating a write cycle signal by delaying the write cycle reference signal by a time period counted by the write cycle signal delay counter, a data request signal generation unit generating a data request signal to request transmission of one line of the image data to a controller unit based on the write cycle signal, and a line memory storing the one line of the image data transmitted from the controller unit in response to the data request signal.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies of an image writing device, resist correction is performed in a manner such that data are stored for a period which corresponds to a shifted timing to transfer the data from a line memory to an LED array. Due to this, it becomes necessary for the line memory to have additional capacity to store at least one line of data.

The present invention is made in light of the above problem, and makes it possible to perform an adjustment of an image writing start position in the sub-scanning direction without additionally increasing the line memory of a write control section.

In the following, embodiments of the present invention are described with reference to the accompanying drawings.

Image Writing Device and Image Writing Method

Figure 1:
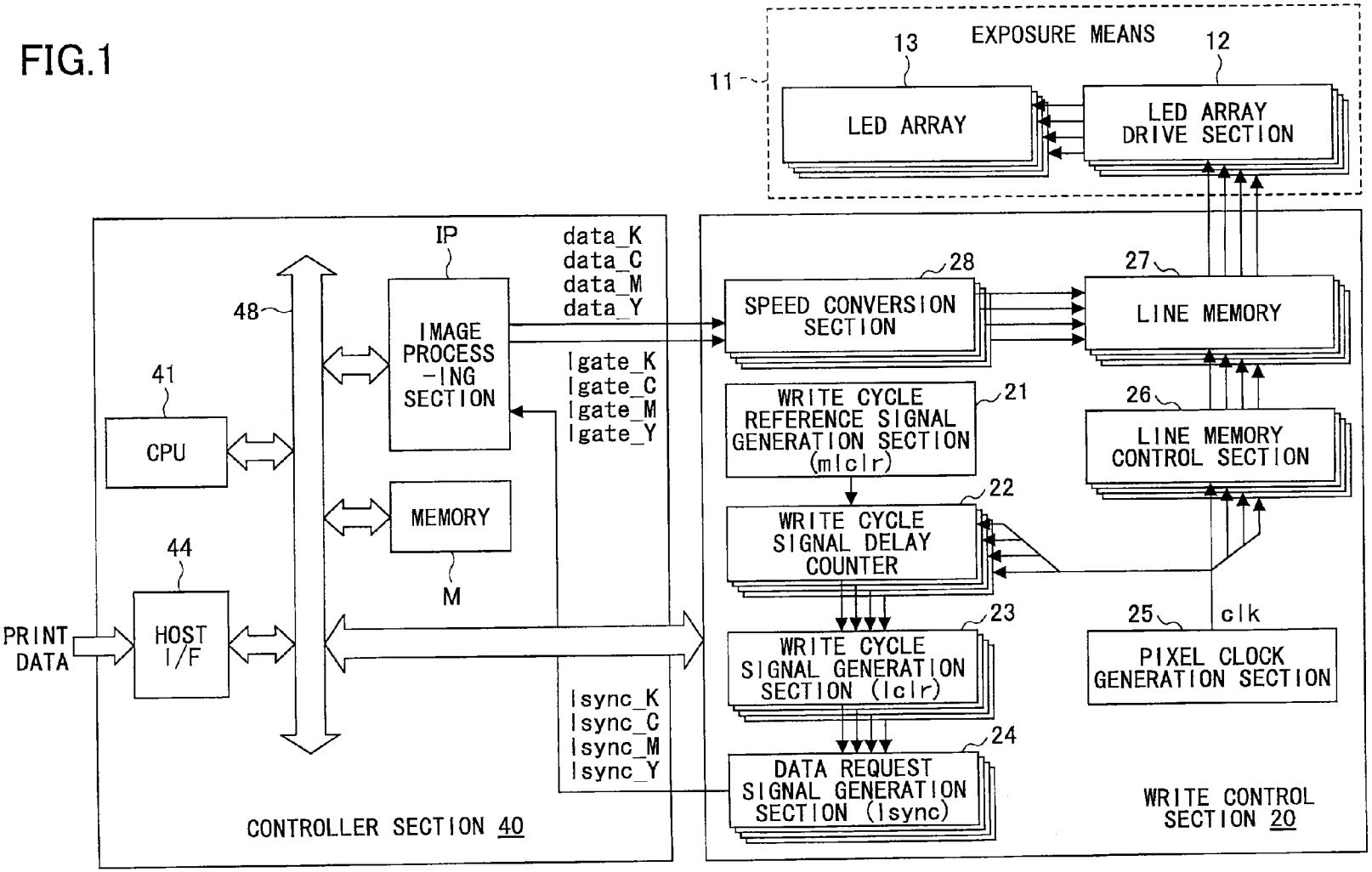
FIG. 1 is a block diagram illustrating an example configuration of a main part of an image writing device according to an embodiment of the present invention along with a controller section.
Figure 2:
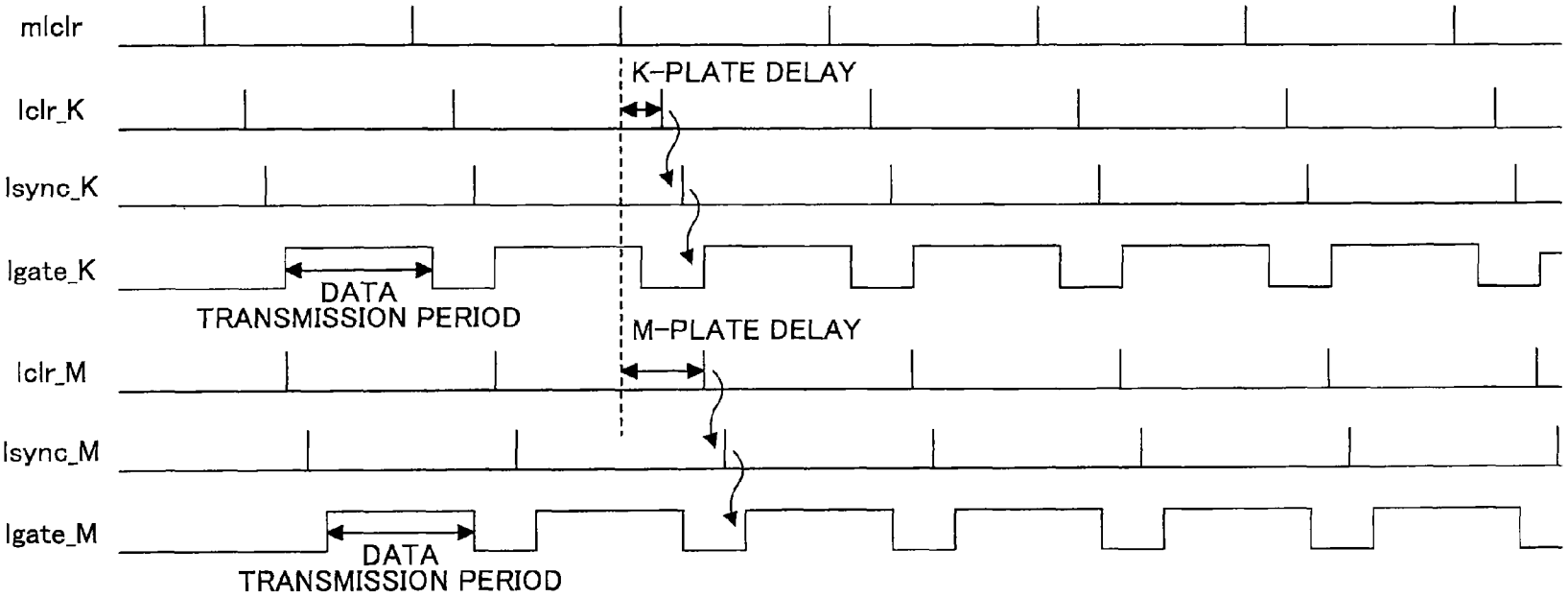
FIG. 2 is a timing chart illustrating example relationships between signals used in an image writing method performed by the image writing device of FIG. 1.

First, an image writing device according to an embodiment of the present invention is described with reference to FIGS. 1 and 2. FIG. 1 is a block diagram illustrating an example configuration of a main part of the image writing device according to an embodiment along with a control section. FIG. 2 is a timing chart illustrating example relationships between signals used in an image writing method performed by the image writing device.

The image writing device of FIG. 1 includes an exposure means 11 and a write control section 20. The exposure means 11 includes an LED array 13, which is an exposure head that exposes an image bearing surface which is an outer peripheral surface of a photoconductor drum (not shown), and an LED array drive section 12 which drives the LED array 13. The LED array drive section 12 may be provided in combination with the LED array 13. However, for the explanatory purposes, the LED array drive section 12 is herein described separately from the LED array 13.

The LED array 13 includes LED elements, which are plural light-emitting elements that are arranged in a surface that forms along (faces) the image bearing surface, in an array manner, in density in accordance with a writing resolution, and along the main-scanning direction (i.e. the axis direction of the photoconductor drum) orthogonal to the sub-scanning direction which is the moving direction of the image bearing surface.

The LED array drive section 12 controls the turning on and off of the LED elements of the LED array 13 based on image data transmitted from the write control section 20, so as to repeatedly expose the image bearing surface along the main-scanning direction, the image bearing surface being moved in the sub-scanning direction of a photoconductor drum 10.

The image writing device in this embodiment can form a full-color image. Therefore, the exposure means 11 includes four sets of the LED array drive sections 12 and the LED arrays 13, so that images of the four-color (i.e., yellow (Y), magenta (M), cyan (C) and black (K)) image data can be written on the respective image bearing surfaces of the photoconductor drums 10 for the four colors.

The write control section 20 includes a write cycle reference signal generation section 21, a write cycle signal delay counter 22, a write cycle signal generation section 23, a data request signal generation section 24, a pixel clock generation section 25, a line memory control section 26, a line memory 27, and a speed conversion section 28.

The elements other than the write cycle reference signal generation section 21 and the pixel clock generation section 25 include four sets of the respective elements for the four colors (color plates). In FIG. 1, those elements are displayed in a slightly overlapped manner. However, note that it is not always necessary that such elements be physically separated into respective four parts, as long as the elements can generate (handle) the respective four-color signals.

The write cycle reference signal generation section 21 generates a write cycle reference signal "mlclr" having a cycle corresponding to the writing resolution which becomes a base of write cycle signals "lclr" for all the colors (color plates) (i.e., "lclr_K", "lclr_C", "lclr_M", and "lclr_Y"). Note that the above-described density of the LED elements arranged in the LED array 13 corresponds to the writing resolution in the main-scanning direction, and, on the other hand, the cycle of the write cycle reference signal "mlclr" corresponds to the writing resolution in the sub-scanning direction. However, generally, the writing resolution in the main-scanning direction is the same as the writing resolution in the sub-scanning direction. Therefore, in the following, the simplified term "writing resolution" is used.

The write cycle signal delay counter 22 counts a pixel clock "clk" that is generated by the pixel clock generation section 25 by each of the respective count values that are set for the colors (color plates). The write cycle signal generation section 23 generates the write cycle signals "lclr" by delaying the write cycle reference signal "mlclr" by the respective time periods counted by the write cycle signal delay counter 22.

The count values that are set in write cycle signal delay counter 22 may be arbitrarily (set) determined. However, in this embodiment, the count values are calculated by a Central Processing Unit (CPU) 41 of a controller section 40 based on a color matching operation. The count values correspond to time periods for correcting the shifts (differences) of the image writing start positions (sub-scanning writing start positions). In this embodiment, a case is described where the clock that is counted is the pixel clock "clk", which is used for transmitting the image data, and that is generated by the pixel clock generation section 25. However, for example, an appropriate clock may alternatively be used which has a cycle sufficiently smaller than the time period for correcting the shifts of the image writing start positions.

The data request signal generation section 24 generates data request signals "lsync" for all the colors (color plates) (i.e., "lsync_K", "lsync_C", "lsync_M", and "lsync_Y") based on the respective write cycle signals "lclr" for all the colors (color plates) (i.e., "lclr_K", "lclr_C", "lclr_M", and "lclr_Y"), and transmits the generated data request signals "lsync" to an image processing section IP of the controller section 40, so as to send a request to the image processing section IP to transmit one (single) lines of the image data of the respective colors (color plates).

Upon receiving the data request signals "lsync" for all the colors (color plates) (i.e., "lsync_K", "lsync_C", "lsync_M", and "lsync_Y"), the image processing section IP of the controller section 40 transmits the requested image data of the colors (color plates) (i.e., "data_K", "data_C", "data_M", and "data_Y") to the speed conversion section 28 of the write control section 20 within respective data transmission periods defined by line gate signals "lgate" of the colors (color plates) (i.e., "lgate_K", "lgate_C", "lgate_M", and "lgate_Y").

The speed conversion section 28 converts the frequencies of the image data (i.e., "data_K", "data_C", "data_M", and "data_Y") that are input on a pixel basis based on predetermined frequencies from the image processing section IP of the controller section 40, and then stores the image data in the respective parts of the line memory 27.

A set of pixel information, which corresponds to the image data of the colors stored by the speed conversion section 28, is read from the line memory 27 under the control of the line memory control section 26 that is operated by the pixel clock "clk", and is transmitted to the LED array drive section 12 of the exposure means 11.

The pixel clock generation section 25 transmits the generated pixel clock "clk" to the write cycle signal delay counter 22 and the line memory control section 26 for four colors (color plates).

Similar to the controller section 40, the write control section 20 includes a micro-computer including the CPU, memories such as a Read-Only Memory (ROM) and a Random Access Memory (RAM), etc. The above-described functions are realized by a combination of software processing performed by the micro-computer and the hardware configuration described above.

The controller section 40 controls the entire image forming apparatus. Further, the controller section 40 includes the CPU 41, a memory M such as the ROM, the RAM, etc., the image processing section IP, and a host interface (I/F) 44, which are connected to each other via a system bus 48, so that a micro-computer is formed.

Further, upon receiving print data from an external host device such as a personal computer (PC) by the host I/F 44, the image processing section IP develops the print data to form image data of the respective colors (color plates) in a bit map manner on a page basis. In accordance with the data request signals "lsync" for all the colors (color plates) (i.e., "lsync_K", "lsync_C", "lsync_M", and "lsync_Y") from the write control section 20, the controller section 40 transmits the image data of the respective colors (color plates) to the write control section 20 on a one-line basis.

Although the functions of the image processing section IP are performed by the CPU 41 by using the memory M, the CPU 41 and the memory M are separately illustrated from the image processing section IP to be easily understood (for explanatory purposes).

Here, an image writing method by using the image writing device is described with reference to FIG. 2. FIG. 2 is a timing chart illustrating relationships between signals used in the image writing method. Specifically, FIG. 2 illustrates the relationships among the write cycle reference signal "mlclr", the write cycle signal for black color (color plate) "lclr_K", the data request signal for black color (color plate) "lsync_K", the line gate signal for black color (color plate) "lgate_K", the write cycle signal for magenta color (color plate) "lclr_M", the data request signal for magenta color (color plate) "lsync_M", and the line gate signal for magenta color (color plate) "lgate_M".

First, the write cycle reference signal "mlclr", which becomes a base of the write cycle signals for all the colors (color plates) "lclr", is generated by the write cycle reference signal generation section 21. The cycle of the write cycle reference signal "mlclr" corresponds to the writing resolution. However, it is preferable to detect variation (change) of the moving speed of an image bearer in the sub-scanning direction so as to adjust (correct) the writing position based on the variation. The variation (change) of the moving speed of the image bearer in the sub-scanning direction can be detected based on the rotational speed of the photoconductor drum and the moving speed of a transfer feeding belt or an intermediate transfer belt described below by detecting, for example, the rotational speed of the rotation axis thereof and the rotational speed of the rotation member of the drive motor or the driving force transmission mechanism thereof.

Then, the write cycle signal generation section 23 generates the write cycle signals "lclr" for all the colors (color plates) (i.e., "lclr_K", "lclr_C", "lclr_M", and "lclr_Y") by delaying the write cycle reference signal "mlclr" by the respective time periods (count values) counted by the write cycle signal delay counter 22.

The respective count values that are counted by the write cycle signal delay counter 22 can be arbitrarily set (determined). Therefore, it is possible to set the count values so as to correspond to the time periods for correcting misalignments (shifts) of the image writing start positions (i.e., the sub-scanning writing start positions) which are less than the one line cycle and are calculated by the color matching operation.

FIG. 2 illustrates the delayed write cycle signal for black color (color plate) "lclr_K" having a delay of "K-plate delay" and the delayed write cycle signal for magenta color (color plate) "lclr_M" having a delay of "M-plate delay".

Based on the write cycle signals "lclr" for all the colors (color plates) (i.e., "lclr_K", "lclr_C", "lclr_M", and "lclr_Y"), the data request signal generation section 24 generates the respective data request signals "lsync" for all the colors (color plates) (i.e., "lsync_K", "lsync_C", "lsync_M", and "lsync_Y"), and transmits the generated data request signals "lsync" to the controller section 40.

FIG. 2 illustrates the data request signal for black color (color plate) "lsync_K" and the data request signal for magenta color (color plate) "lsync_M".

Upon receiving the data request signals "lsync" for all the colors (color plates) (i.e., "lsync_K", "lsync_C", "lsync_M", and "lsync_Y"), the image processing section IP transmits the image data of the colors (color plates) by one line at a time. The data transmission periods of the colors (color plates) are defined by the respective line gate signals "lgate" of the colors (color plates) (i.e., "lgate_K", "lgate_C", "lgate_M", and "lgate_Y").

FIG. 2 illustrates the line gate signal for black color (color plate) "lgate_K" and the line gate signal for magenta color (color plate) "lgate_M".

In the image writing method in this embodiment, it is assumed that the count values of the colors (color plates) that are set to the write cycle signal delay counter 22 correspond to the time periods that are for correcting the misalignments (shifts) of the image writing start positions (the sub-scanning writing start positions) which are less than or equal to the one line cycle (correction time periods).

Due to this, the write cycle signals "lclr" for all the colors (color plates) (i.e., "lclr_K", "lclr_C", "lclr_M", and "lclr_Y") and the data request signals "lsync" for all the colors (color plates) (i.e., "lsync_K", "lsync_C", "lsync_M", and "lsync_Y") based on the respective write cycle signals "lclr" are generated with the respective delays in accordance with the correction time periods. Due to the delayed signals, the data transmission periods, within which the corresponding image data of the colors (color plates) are transmitted from the image processing section IP of the controller section 40 to the write control section 20, are delayed based on the correction time periods.

In other words, it is possible to delay the timings when the write control section 20 receives the image data of the colors (color plates) from the controller section 40 by the corresponding correction time periods of the sub-scanning writing start positions which are less than or equal to the one-line cycle of the main scanning.

Therefore, the image data (pixel information) of the colors (color plates) are stored in the line memory 27 via the speed conversion section 28 at the timings when the respective sub-scanning writing start positions are corrected.

Due to this, it becomes possible for the write control section 20 to perform the data accumulation and the data transmission to the LED array drive section 12 without correcting the sub-scanning writing start positions by the line memory 27.

Therefore, it becomes unnecessary to have an additional line memory to be used for the correction of the sub-scanning writing start positions.

Namely, without storing the data in the line memory in order to shift the sub-scanning writing start timings, the timings to transmit the image data of the colors (color plates) from the controller section 40 to the write control section 20 are shifted by the respective timing periods corresponding to the sub-scanning writing start timings to be shifted. By doing this, it becomes possible to cut (reduce) the line memory for each of the colors by one line at a time.

Image Forming Apparatus

Next, an image forming apparatus according to an embodiment of the present invention is described.

Figure 3:
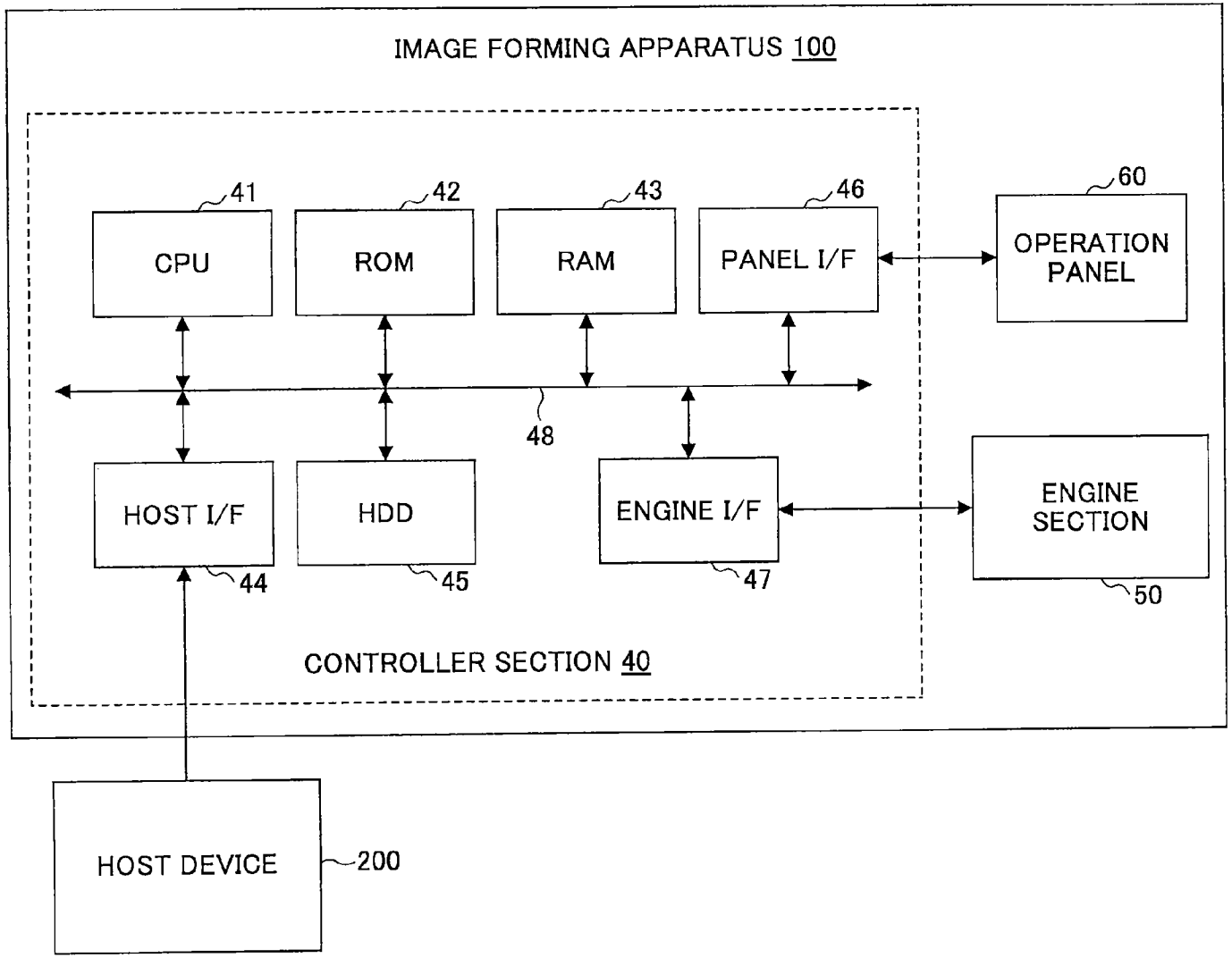
FIG. 3 is a block diagram illustrating an example overall configuration of an image forming apparatus according to an embodiment of the present invention.
Figure 4:
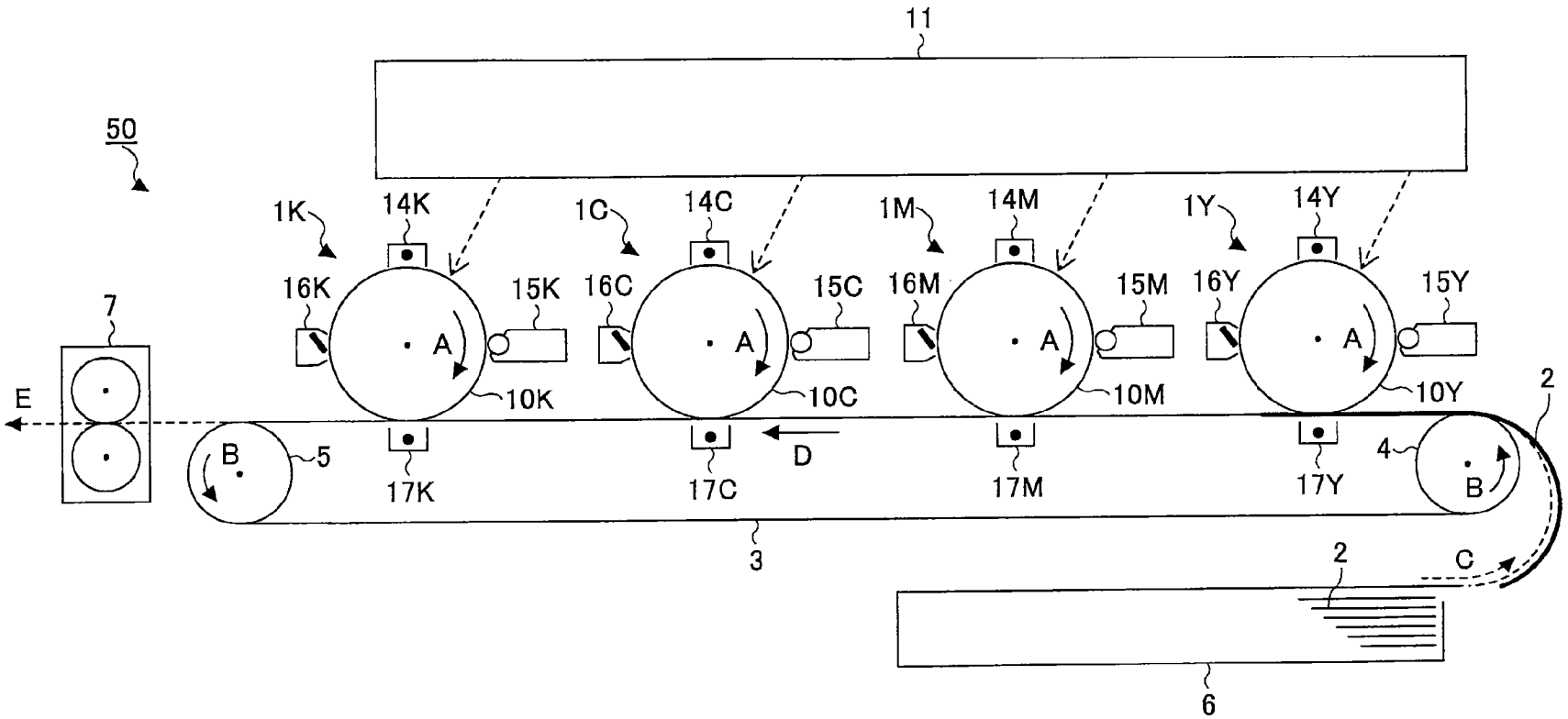
FIG. 4 is a drawing schematically illustrating an example configuration around an image formation unit in an engine section of the image forming apparatus.

FIG. 3 is a block diagram illustrating an example overall configuration of an image forming apparatus 100 according to an embodiment of the present invention. FIG. 4 schematically illustrates an example configuration around an image formation unit of an engine section 50 of the image forming apparatus 100.

The image forming apparatus 100 of FIG. 3 includes the controller section 40, the engine section 50, and an operation panel 60.

As described above with reference to FIG. 1, the controller section 40 controls the entire image forming apparatus (serves as an overall control section), and includes the CPU 41, a ROM 42, a RAM 43, the host I/F 44, a hard disk drive (HDD) 45, a panel I/F 46, and an engine I/F 47. Those elements are mutually connected to each other via the system bus 48, so that data, address, and control signals can be transmitted and received and the micro-computer is formed.

As described above, the terms "I/F" and "HDD" refer to the "interface" and the "hard disk drive", respectively.

The CPU 41 is a central processing unit that collectively controls the overall image forming apparatus 100 by selectively executing a program stored in the ROM 42 or the HDD 45 and using the RAM 43 as a work area.

The ROM 42 is a memory from which fixed data, etc., stored in advance are read to be used for the execution of the programs by the CPU 41.

The RAM 43 is used as the work area when the program is executed by the CPU 41, and is a data-readable/writable memory for temporarily storing data.

The host I/F 44 is an interface to communicate with a host device 200 via a network, so as to receive print data transmitted from the host device 200 which is an information processing apparatus such as a PC, etc.

The HDD 45 is a non-volatile large-capacity storage device (hard disk drive) storing the programs to be executed by the CPU 41, the fixed data to be used for the execution of the programs, and various setting values in an editable manner. The received print data can be temporarily stored in the HDD 45.

In place of or in addition to the HDD 45, a non-volatile memory such as a non-volatile ROM, etc., may be used. The ROM 42, the RAM 43, the HDD 45, etc., correspond to the memory M in FIG. 1.

The panel I/F 46 is an interface to transmit and receive signals and data to and from the operation panel 60. The operation panel 60 is provided, for example, on a front surface or an upper surface of the chassis (main body) of the image forming apparatus 100, and includes a group of keys and a display section such as a liquid crystal display or the like.

The engine I/F 47 is an interface to transmit and receive signals and data to and from the engine section 50 (a.k.a. a printer engine) including an image forming mechanical section that actually performs image forming, a driving circuit to drive the image forming mechanical section, etc.

The engine section 50 includes the exposure means 11 and the write control section 20, which are described with reference to FIG. 1 and an image forming section (not shown in FIG. 1) including, for example, the image formation unit including photoconductor drums 10.

The controller section 40 develops the print data received from the host device 200 to form the image data of the respective colors (color plates) in a bit map manner on a page basis in a memory such as the RAM 43, etc., and then transmits the image data to the write control section 20 of the engine section 50 by one line at a time for each of the colors (color plates). Namely, the controller section 40 has a function of the image processing section IP in FIG. 1.

Engine Section of a Color Image Forming Apparatus

The image forming apparatus in this embodiment is a color image forming apparatus that can form a color image. An example configuration around the image formation unit of the engine section 50 is described with reference to FIGS. 4 and 5.

Figure 5:
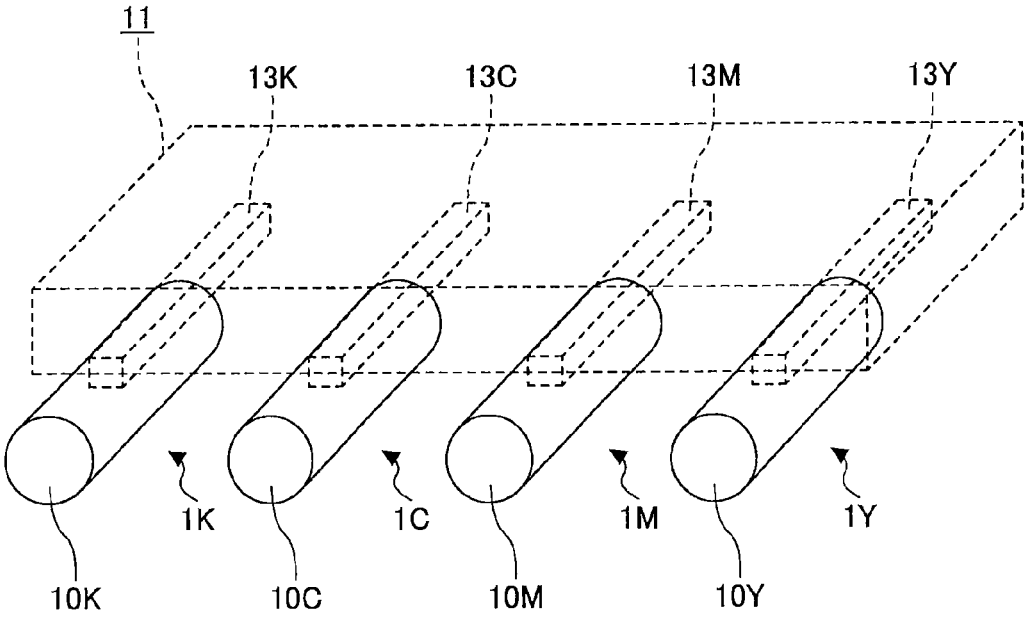
FIG. 5 is a perspective view illustrating only the photoconductor drums and the exposure means of colors of the image forming unit.

FIG. 4 schematically illustrates an example configuration around the image forming unit in the engine section 50 for forming a color image. FIG. 5 is a perspective view illustrating only the photoconductor drums 10 of the colors and the exposure means 11. Note that the exposure means 11 is illustrated in dotted lines in FIG. 5.

The engine section 50 of FIG. 4 is an image forming section employing a tandem-type direct transfer method that can form a full-color image.

This engine section 50 include four image formation units 1Y, 1M, 1C, and 1K which together form four-color (i.e., yellow (Y), magenta (M), cyan (C), and black (K), respectively) images. Those four image formation units 1Y, 1M, 1C, and 1K are arranged in this order and separated at a predetermined distance along the moving direction (arrow "D" direction) of a transfer feeding belt 3 that feeds a transfer sheet 2 which is a recording medium.

The transfer feeding belt 3 is stretched substantially horizontally between a driving roller 4 and a driven roller 5 and is circularly (continuously) moved (turned) in the arrow "D" direction. Here, the driving roller 4 is circularly driven in the arrow "B" direction by a driven motor (not shown), and the driven roller 5 is disposed in parallel with and is separated by a distance from the driving roller 4.

Under the transfer feeding belt 3, there is provided a sheet tray 6 where the transfer sheets 2 are stored.

Among the transfer sheets 2 stored in the sheet tray 6, the upper-most transfer sheet 2 is fed in the arrow "C" direction toward the transfer feeding belt 3 upon start of image forming, and is held on the transfer feeding belt 3 by electrostatic attraction, so as to be moved in the arrow "D" direction and fed to the transfer position of the image formation unit 1Y.

The image formation units 1Y, 1M, 1C, and 1K include respective photoconductor drums 10Y, 10M, 10C, and 10K and chargers 14Y, 14M, 14C, and 14K, developing devices 15Y, 15M, 15C, and 15K, photoconductor cleaners 16Y, 16M, 16C, and 16K, and transferring devices 17Y, 17M, 17C, and 17K which are respectively disposed around the photoconductor drums 10Y, 10M, 10C, and 10K.

In FIGS. 4 and 5, the reference numerals of the photoconductor drums, the chargers, the developing devices, the photoconductor cleaners, the transferring devices include a suffix letter "Y", "M", "C", or "K" to distinguish one from another.

However, the functions are the same even when only the suffix letter differs. Therefore, in the description, the elements may be collectively described without using the suffix letters.

As schematically illustrated in FIG. 5, the LED array 13 is disposed between the charger 14 and the developing device 15 around the photoconductor drum 10 of the image formation units 1Y, 1M, 1C, and 1K. However, in FIG. 4, the LED arrays 13 in the image formation units 1Y, 1M, 1C, and 1K are included in the exposure means 11 for convenience. Therefore, in FIG. 4, only the optical axes of the LED arrays 13 are illustrated in the respective dotted lines and arrows.

Further, the exposure means 11 is illustrated (provided) as a single unit relative to the image formation units 1Y, 1M, 1C, and 1K. However, the exposure means 11 includes the LED arrays 13 and the LED array drive sections 12 for all the colors (color plates). In this regard, the exposure means 11 may be provided as separated units.

The photoconductor drums 10 of the image formation units 1Y, 1M, 1C, and 1K are driven to rotate in the respective arrow "A" directions at a predetermined speed, and the surfaces of the photoconductor drums 10 are uniformly charged by the chargers 14 at respective instructed timings. Then, the photoconductor drums 10 are exposure-scanned by the light beams corresponding to the images of the colors irradiated as illustrated by the dotted lines and arrows by using the LED elements of the LED arrays 13 of the exposure means 11. By doing this, electrostatic latent images are formed on the image bearing surfaces which are the outer peripheral surfaces of the photoconductor drums 10.

The electrostatic latent images are developed with respective color toner by the developing devices 15, so that toner images of the respective colors are formed on the image bearing surfaces of the photoconductor drums 10 of the image formation units 1Y, 1M, 1C, and 1K.

The toner images of the respective colors are sequentially superimposed and directly transferred onto the transfer sheet 2 by the transferring devices 17 at the transferring positions where the transfer sheet 2 on the transfer feeding belt 3 is in contact with the photoconductor drums 10, so that a full-color image is formed on the image bearing surface of the transfer sheet 2.

Remaining and unnecessary toner on the surfaces of the photoconductor drums 10 after transferring is cleaned off by the respective photoconductor cleaners 16, so as to be ready for the next image forming.

The transfer sheet 2, that has passed through the image formation unit 1K and on which the full-color image is formed, is detached (separated) from the transfer feeding belt 3 and is fed to a fixing device 7, so that the full-color toner image is fixed. After that, the transfer sheet 2 is discharged in the arrow "E" direction.

By the operation by the write control section 20 as described above, it becomes possible to correct the misalignments (shifts) of the image writing start positions (i.e., the sub-scanning writing start positions) on the respective image bearing surfaces on the photoconductor drums 10 with an accuracy of less than or equal to one line cycle of the main scanning. As a result, it becomes possible to eliminate (reduce) the misalignments between the toner images of the colors which are sequentially superimposed and transferred onto the transfer sheet 2, so that it becomes possible to form a high-quality full-color image without causing color shift.

Herein, the term "sub-scanning" refers to the scanning in the moving direction of the image bearing surface by the rotation of the photoconductor drum 10. On the other hand, the term "main-scanning" refers to the scanning in the direction orthogonal to the "sub-scanning" direction on a plane parallel to the image bearing surface (i.e., the direction of the axis of the photoconductor drum 10). In this embodiment, the LED arrays 13 are displayed along the main-scanning direction near the image bearing surfaces of the photoconductor drums 10, and plural LED elements of the LED arrays 13 are arranged in the main-scanning direction in an array manner with a density in accordance with the writing resolution. Accordingly, the main scanning is performed by the LED arrays 13.

In this embodiment, a case is described where the engine section 50 is the image forming section that employs the tandem-type direct transfer method. However, note that the present invention may also be applied to a color image forming apparatus including an image forming section that employs a tandem-type or revolving-type direct transfer method. In this case, there is provided an intermediate transfer body such as an intermediate transfer belt or an intermediate transfer drum, so that toner images of the colors, which are formed by the respective image formation units, are sequentially superimposed (i.e., perform primary transfer) to form a full-color toner image on the image bearing surface of the intermediate transfer body. Then, the full-color toner image on the image bearing surface of the intermediate transfer body is collectively secondarily transferred onto the transfer sheet. Namely, there is provided a means for superimposing and transferring the toner images of the colors formed by the image formation units indirectly onto the transfer sheet which is a recording medium.

Even in this case, by using the above-described image writing device and the image writing method according the embodiments, it becomes also possible to correct the misalignments of the colors with higher accuracy when the toner images of the colors formed by the image formation units are sequentially transferred to perform the primary transfer. Therefore, it becomes possible to form a high-quality full-color image without causing color shift.

In addition, it is no longer necessary to provide an additional line memory, so that it becomes possible to avoid cost increase.

Further, note that the number of the colors forming the color image is not limited to four. For example, the number of the colors forming the color image may be two, three, or five or more. In such a case, the number of the elements of the colors in the exposure means 11 and the write control section 20 to be provided is set to be equal to the number of the colors to be used.

Figure 6:
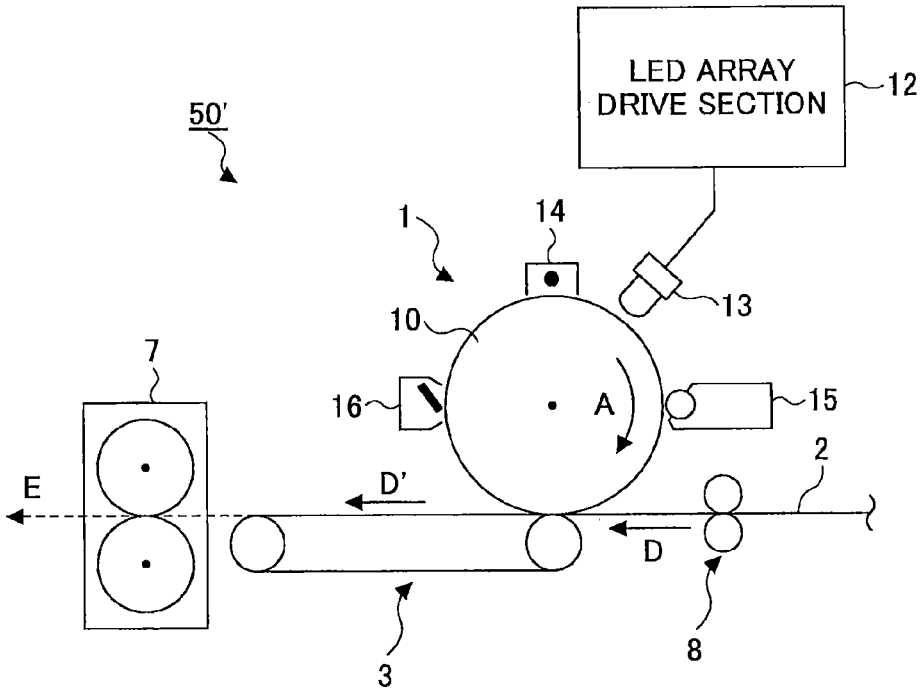
FIG. 6 is a drawing schematically illustrating an example configuration around the image formation unit in a case where the engine section of the image forming apparatus is for single-color image forming.

Note that the present invention can be applied to not only a color image forming apparatus but also an image forming apparatus that forms a single-color image. An example configuration around the image formation unit in the engine section in this case is described with reference to FIG. 6. In FIG. 6, the same reference numerals are used to describe the elements that corresponds to the elements in FIG. 4. However, in FIG. 6, the description of the suffix letter "Y", "M", "C", or "K" is omitted.

An engine section 50' of FIG. 6 is an image forming section which includes the image formation unit 1 that forms a single-color image on the transfer sheet 2 which is a recording medium based on the image formation using the electrophotography method.

The image formation unit 1 includes the photoconductor drum 10, the transfer feeding belt 3, and the charger 14, the LED array 13, the developing device 15, and the photoconductor cleaner 16, which are disposed around the photoconductor drum 10. The LED array 13 and the LED array drive section 12 constitute the exposure means 11 of FIG. 1.

The position where the image bearing surface, which is the outer peripheral surface of the photoconductor drum 10, is in contact with the transfer feeding belt 3 is the transfer position. A pair of positioning rollers (which is also called "a pair of registration rollers") 8 is provided at the position on the upstream side of the transfer position in a transfer sheet feed direction as illustrated by the arrow "D", the pair of positioning rollers 8 being separated from the transfer position by a predetermined distance. The pair of positioning rollers 8 sandwiches the front edge of the transfer sheet 2 which is fed from a sheet supply section (not shown) to temporarily stop the transfer sheet 2. After that, the pair of positioning rollers 8 is driven again to rotate to feed the transfer sheet 2 in the arrow "D" direction, in a manner so that the front edge of the toner image on the photoconductor drum 10 is in contact with the header edge of the image transfer area of the transfer sheet 2 at the transfer position by adjusting the timing when the image writing by the LED array 13 starts.

The photoconductor drum 10 of the image formation unit 1 is driven to rotate at a predetermined speed in the arrow "A" direction, so that the image bearing surface, which is a light-sensitive surface, is uniformly charged by the charger 14 at a predetermined timing. Then, the exposure by the light emission of the LED elements of the LED array 13 is repeated in the main-scanning direction which is the direction of the axis of the photoconductor drum 10 (the vertical direction relative to the sheet surface of FIGS. 4 and 6). Due to the repeated exposure, the electrostatic latent image is formed on the image bearing surface of the photoconductor drum 10.

In this case, the direction in which the image bearing surface is moved by the rotation of the photoconductor drum 10 is the sub-scanning direction.

The electrostatic latent image is developed by the toner, which is a developer, at the position of the developing device 15, so that the toner image is formed on the image bearing surface of the photoconductor drum 10. In the case of the single-color image, black toner is generally used. However, toner of another color such as red, blue, etc., may alternatively be used.

The toner image is in direct contact with the image bearing surface of the transfer sheet 2 at the transfer position where the photoconductor drum 10 is in contact with the transfer sheet 2 on the transfer feeding belt 3, so that the toner image is formed on the transfer sheet 2.

After transferring, unnecessary toner remaining on the surface of the photoconductor drum 10 is cleaned off (removed) by the photoconductor cleaner 16, so as to be ready for the next image forming.

The transfer sheet 2, that has passed through the image formation unit 1 and on which the toner image is formed, is fed in the arrow "D'" direction by the transfer feeding belt 3 to the fixing device 7. While the transfer sheet 2 passes through the fixing device 7, the toner image is fixed by heat and pressure. Then, the transfer sheet 2 is discharged in the arrow "E" direction.

Even in this case, by using the above-described image writing device and the image writing method according the embodiments, it becomes possible to correct the misalignment of the image writing start position (sub-scanning writing start position) caused by the LED array 13 relative to the image bearing surface of the photoconductor drum 10 with an accuracy of less than one line cycle of the main scanning.

Accordingly, it becomes possible to prevent the positional misalignment of the toner image to be transferred onto the transfer sheet 2. Especially, in a case where new characters are printed on a ledger sheet or a manuscript paper on which a format including frame border lines is printed, it is possible to perform optimal printing without causing shifts.

Further, in this case, the number of the LED array drive sections 12 may be one, and the number of the LED arrays 13 in the exposure means 11 may be one. Further, the number of each of the elements including respective four parts for four colors in the write control section 20 may be one as well.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

For example, the shape of the photoconductor is not limited to a drum shape. For example, the shape of the photoconductor may be a belt shape. Further, for example, the light-emitting elements arranged in the exposure head are not limited to the LED elements. For example, organic EL elements, etc., may alternatively be used.

Further, an image forming apparatus to which the image writing device and the image writing method according embodiments of the present invention are applied is not limited to a printer. For example, the image forming apparatus according to the present invention may also be applied to, for example, a printing device, a copy machine, a facsimile machine, and a multifunction peripheral having those functions.

Further, it is needless to say that the above-described configurations, functions, etc., in embodiments of the present invention may be, for example, appropriately added, changed, partially omitted, and combined unless (mutual) contradiction occurs.

What is claimed is:

1. An image writing device comprising:

an exposure unit including an exposure head, and configured to write an image onto an image bearing surface of a photoconductor, which moves in a sub-scanning direction at a predetermined speed, by causing the exposure head, where plural light-emitting elements are arranged in a main-scanning direction orthogonal to the sub-scanning direction and in a surface along the image bearing surface, to repeatedly expose the image bearing surface along the main-scanning direction; and a write control unit configured to transmit image data, which are to be written by the exposure unit, to the exposure unit on a one-line basis, wherein the write control unit includes a write cycle reference signal generation unit configured to generate a write cycle reference signal having a cycle corresponding to writing resolution, a write cycle signal delay counter configured to count a clock by a predetermined count value that is set in the write cycle signal delay counter, a write cycle signal generation unit configured to generate a write cycle signal by delaying the write cycle reference signal by a time period counted by the write cycle signal delay counter, a data request signal generation unit configured to generate a data request signal to request transmission of one line of the image data to a controller unit based on the write cycle signal, and a line memory configured to store the one line of the image data transmitted from the controller unit in response to the data request signal.

2. The image writing device according to claim 1, wherein the predetermined count value that is set in the write cycle signal delay counter corresponds to a time period to correct misalignment, which is less than or equal to one line cycle, of an image writing start position.

3. The image writing device according to claim 1, wherein the exposure unit, the write cycle signal delay counter, the write cycle signal generation unit, the data request signal generation unit, and the line memory of the write control unit are configured to correspond to plural color plates, and wherein counter values, corresponding to the plural color plates, that are set in the write cycle signal delay counter correspond to time periods to correct respective misalignments of image writing start positions, the misalignments being less than or equal to one line cycle and being calculated based on a color matching operation.

4. An image forming apparatus comprising:

the image writing device according to claim 3; and a means for developing images, into different colors, which are written, by the exposure unit corresponding to the plural color plates, on the image bearing surfaces of plural photoconductors, and transferring the images by directly or indirectly superimposing the images on a recording medium.

5. The image writing device according to claim 1, wherein the clock counted by the write cycle signal delay counter is a pixel clock.

6. The image writing device according to claim 1, wherein the exposure head is an LED array where plural LED elements are arranged in the main-scanning direction with a density in accordance with the writing resolution.

7. An image forming apparatus comprising:

the image writing device according to claim 1; and a means for developing an image which is written on the image bearing surface of the photoconductor of the image writing device, and transferring the image onto a recording medium.

8. An image writing method comprising:

a writing step of writing an image onto an image bearing surface of a photoconductor, which moves in a sub-scanning direction at a predetermined speed, by causing an exposure head, where plural light-emitting elements are arranged in a main-scanning direction orthogonal to the sub-scanning direction and in a surface along the image bearing surface, to repeatedly expose the image bearing surface along the main-scanning direction; and a write control step of transmitting image data, which are to be written in the writing step, on a one-line basis, wherein in the write control step, a write cycle reference signal having a cycle corresponding to writing resolution is generated, a clock is counted by a predetermined count value that is set in advance, a write cycle signal is generated by delaying the write cycle reference signal by a time period corresponding to the predetermined count value, a data request signal is generated to request transmission of one line of the image data to a controller unit based on the write cycle signal, the one line of the image data transmitted from the controller unit in response to the data request signal is stored in a line memory, and the one line of the image data is transmitted to the exposure head.

9. The image writing method according to claim 8, wherein the predetermined count value corresponds to a time period to correct misalignment, which is less than or equal to one line cycle, of an image writing start position.

10. An image writing device comprising:

first means including an exposure head, and for writing an image onto an image bearing surface of a photoconductor, which moves in a sub-scanning direction at a predetermined speed, by causing the exposure head, where plural light-emitting elements are arranged in a main-scanning direction orthogonal to the sub-scanning direction and in a surface along the image bearing surface, to repeatedly expose the image bearing surface along the main-scanning direction; and second means for transmitting image data, which are to be written by the exposure head, to the exposure head on a one-line basis, wherein the second means includes means for generating a write cycle reference signal having a cycle corresponding to writing resolution, means for counting a clock by a predetermined count value that is set in a write cycle signal delay counter, means for generating a write cycle signal by delaying the write cycle reference signal by a time period counted by the write cycle signal delay counter, means for generating a data request signal to request transmission of one line of the image data to a controller unit based on the write cycle signal, and means for storing the one line of the image data transmitted from the controller unit in response to the data request signal.

11. An image writing device according to claim 10, wherein the predetermined count value corresponds to a time period to correct misalignment, which is less than or equal to one line cycle, of an image writing start position.

* * * * *